US005806773A

United States Patent [19]

Kremer et al.

[11] Patent Number: 5,806,773

[45] Date of Patent: Sep. 15, 1998

[54] CREEL WITH ANTIBALLOONING GUIDES

[75] Inventors: Hubert Kremer, Erkrath; Karl-Heinz Kohlen, Mönchengladbach, both of Germany

[73] Assignee: Sucker-Muller-Hacoba GmbH & Co., Monchen-Gladbach, Germany

[21] Appl. No.: 823,062

[22] Filed: Mar. 21, 1997

[30] Foreign Application Priority Data

Mar. 22, 1996 [DE] Germany ..... 296 05 326 U

[51] Int. Cl.[6] ..... B65H 49/02; B65H 57/00

[52] U.S. Cl. ..... 242/131.1; 242/157 R

[58] Field of Search ..... 242/131, 131.1, 242/157 R

[56] References Cited

U.S. PATENT DOCUMENTS

| | | | |
|---|---|---|---|
| 1,814,203 | 7/1931 | Yates | 242/131.1 |
| 1,872,179 | 8/1932 | Peterson | 242/131.1 |
| 2,325,974 | 8/1943 | Pasquerello | 242/131.1 |
| 3,693,904 | 9/1972 | Bucher | 242/131 |
| 4,538,776 | 9/1985 | Perry . | |
| 4,699,331 | 10/1987 | Zorini . | |
| 5,218,748 | 6/1993 | Tanaka et al. | 242/131.1 X |

FOREIGN PATENT DOCUMENTS

| | | | |
|---|---|---|---|
| 506 027 | 8/1930 | Germany . | |
| 28 41 210 | 10/1981 | Germany . | |
| 1 372 010 | 10/1974 | United Kingdom | 242/131 |

*Primary Examiner*—Michael Mansen
*Attorney, Agent, or Firm*—Herbert Dubno; Andrew Wilford

[57] ABSTRACT

A creel has a frame provided with a plurality of parallel and longitudinally extending rows of holders each adapted to carry a respective filament-carrying bobbin with the holders of each row longitudinally staggered relative to the holders of adjacent rows and defining nonstraight gaps with the holders of the adjacent rows. Respective eyes are aligned transversely of the rows with the holders and filaments pass in a transverse direction from the bobbins to and through the respective eyes. A respective longitudinally extending and nonstraight guide spaced transversely in the direction from the bobbins between the bobbins and the eyes extends parallel to the rows and are each formed level with each holder of the respective rows with an arcuate section directed toward the holders of the respective rows and alignable in a first position in the transverse direction with the gaps between the bobbins.

9 Claims, 7 Drawing Sheets

CREEL WITH ANTIBALLOONING GUIDES

FIELD OF THE INVENTION

The present invention relates to a creel. More particularly this invention concerns a creel that holds a multiplicity of weft or warp bobbins and that is provided with antiballooning structures that limit the balloons formed by the filaments as they are pulled endwise off the respective bobbins.

BACKGROUND OF THE INVENTION

A standard creel has a frame provided with a plurality of vertical rows of holders each adapted to hold a respective bobbin comprised of a tubular core and a mass of filament—yarn or thread—wound on the core. A filament is pulled from each bobbin and guided through a respective eye, whence it passes to a warp or weft system of a loom or the like. The filaments are usually pulled at relatively high speed off the bobbins so that they form a so-called balloon centered on the axis of the bobbin on their way to the eye. The faster the filament moves, the larger the diameter of the balloon. Clearly this is a problem as it requires that the bobbins be spaced widely enough apart that the balloons do not touch each other since any engagement would lead to tangling and breaking of the filaments. Since a standard creel can hold hundreds and even thousands of bobbins, this space requirement is a problem.

Accordingly it has been suggested in German patent 506,027 of Schlafhorst and in U.S. Pat. No. 4,538,776 of Perry to provide an antiballooning guide that reduces the size of this balloon so that the bobbins can be packed relatively close to one another in the frame. While these systems do work fairly well when feeding filaments, they are a substantial hindrance to tending to the machine, for instance changing bobbins. Furthermore, when the bobbins are in staggered rows such as described in U.S. Pat. No. 4,699,331 of Zorini these antiballooning device get in the way to such an extent as to make any work on the equipment very difficult. Swiss patent 671,781 of Bollen suggests a complex pivotal antiballooning system that can be swung out of the way, but this arrangement still poses a substantial obstacle to access to the machine.

German patent document 2,841,210 describes an antiballooning system wherein for each row of bobbins two parallel rods are arranged parallel to the bobbin plane between same and the takeoff eyes through which the filaments are drawn from the creel. The two parallel rods are effective to limit the balloons but must be moved out of the way to allow the bobbins to be changed, necessitating a complex and expensive mounting structure. The rods are normally made fairly light so they are easily bent and damaged when being displaced to work on the machine, and two such rods must be provided for each row of bobbins. Although such an arrangement can be used when the bobbins of each row are staggered with respect to those of the adjacent row or rows, they still are fairly complex and flimsy.

OBJECTS OF THE INVENTION

It is therefore an object of the present invention to provide an improved antiballooning system usable even with staggered rows of bobbins.

Another object is the provision of such an improved antiballooning system usable even with staggered rows of bobbins which overcomes the above-given disadvantages, that is which is simple, which if necessary can easily be moved out of the way for working on the creel, and which is physically robust.

SUMMARY OF THE INVENTION

A creel has according to the invention a frame provided with a plurality of parallel and longitudinally extending rows of holders each adapted to carry a respective filament-carrying bobbin with the holders of each row longitudinally staggered relative to the holders of adjacent rows and defining nonstraight gaps with the holders of the adjacent rows. Respective eyes are aligned transversely of the rows with the holders and filaments pass in a transverse direction from the bobbins to and through the respective eyes. A respective longitudinally extending and nonstraight guide spaced transversely in the direction from the bobbins between the bobbins and the eyes extends parallel to the rows and are each formed level with each holder of the respective rows with an arcuate section directed toward the holders of the respective rows and alignable in a first position in the transverse direction with the gaps between the bobbins.

Thus according to the invention the shapes of the guides conform to the shape of the gaps between the rows of bobbins. This makes it possible to insert and remove bobbins right past the guides in this first position without them interfering with the transverse movement of the bobbins. During takeoff of the filaments the guides effectively limit the balloons so same do not get big enough to tangle with one another. In addition only one guide is needed between two rows, so that for a given number of rows of bobbins one only needs a number of guides equal to the number of rows plus one.

According to the invention the guides are rods and the arcuate sections of each rod are separated by a spacing equal to a longitudinal spacing between adjacent holders in a row. Furthermore each guide rod is rotatable in the frame about an axis flanked by the respective arcuate sections between the first position and a second position with the arcuate sections out of alignment with the gaps of the respective rows and extending into a projection in the transverse direction of the respective bobbins. The rods can be made fairly robust so that if they are hit during loading or unloading of the creel, they will not be damaged, yet rotating them into the out-of-the-way first positions is a relatively simple task entailing minimal machinery.

In accordance with the invention the rods are spaced in the transverse direction from the bobbins. Furthermore they have ends lying on the respective axes and seated rotatable in the frame. Such structure is simple to manufacture and easy to operate.

In another system according to the invention the guides are corrugated plates set between the rows and extending in the transverse direction from the gaps between the rows. The plates can be made of metal, perforated metal, or plastic. Either way the guides have a pair of angled straight sections, normally flanking a central straight section.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
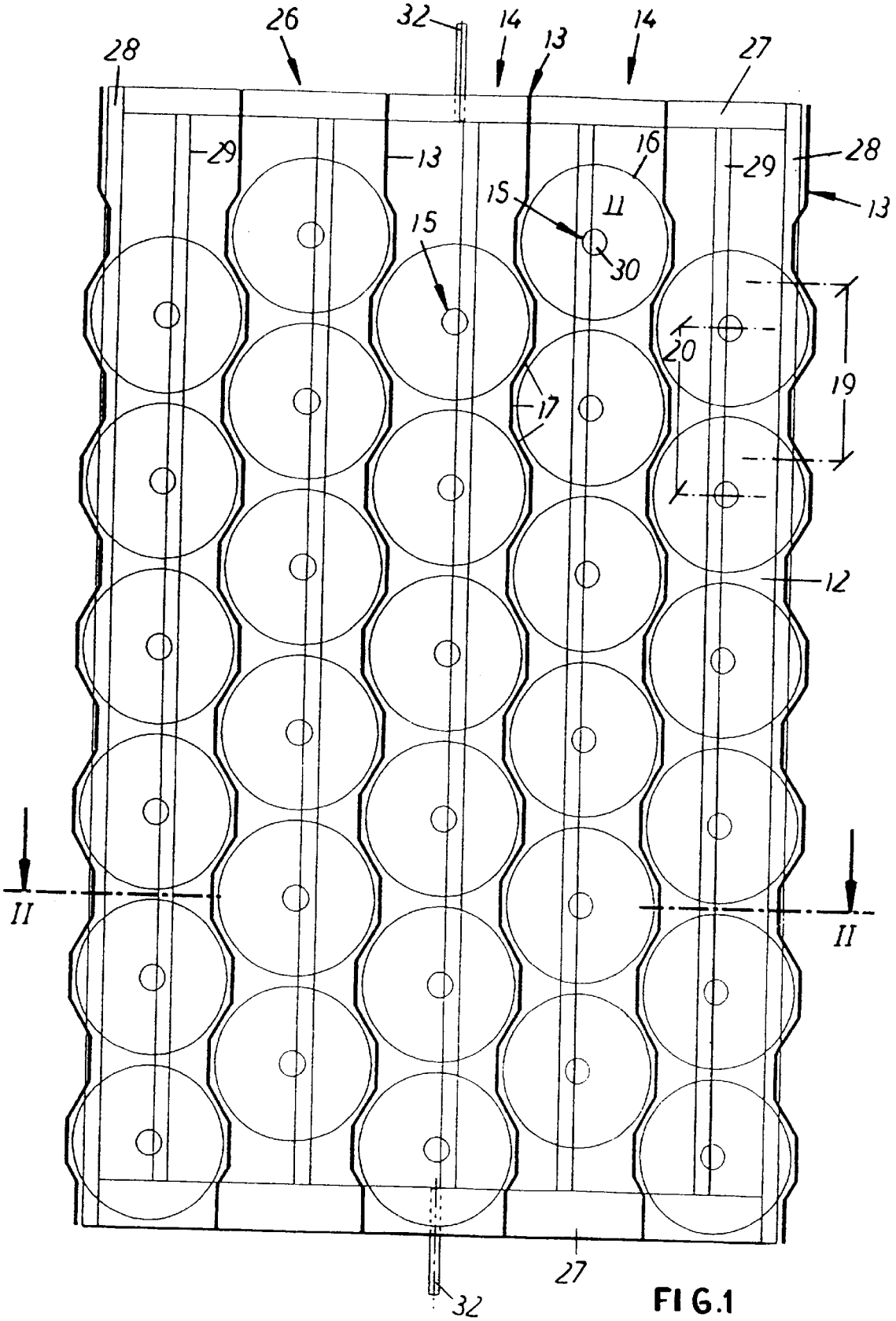
FIG. 1 is an end view of a creel according to the invention.
Figure 2:
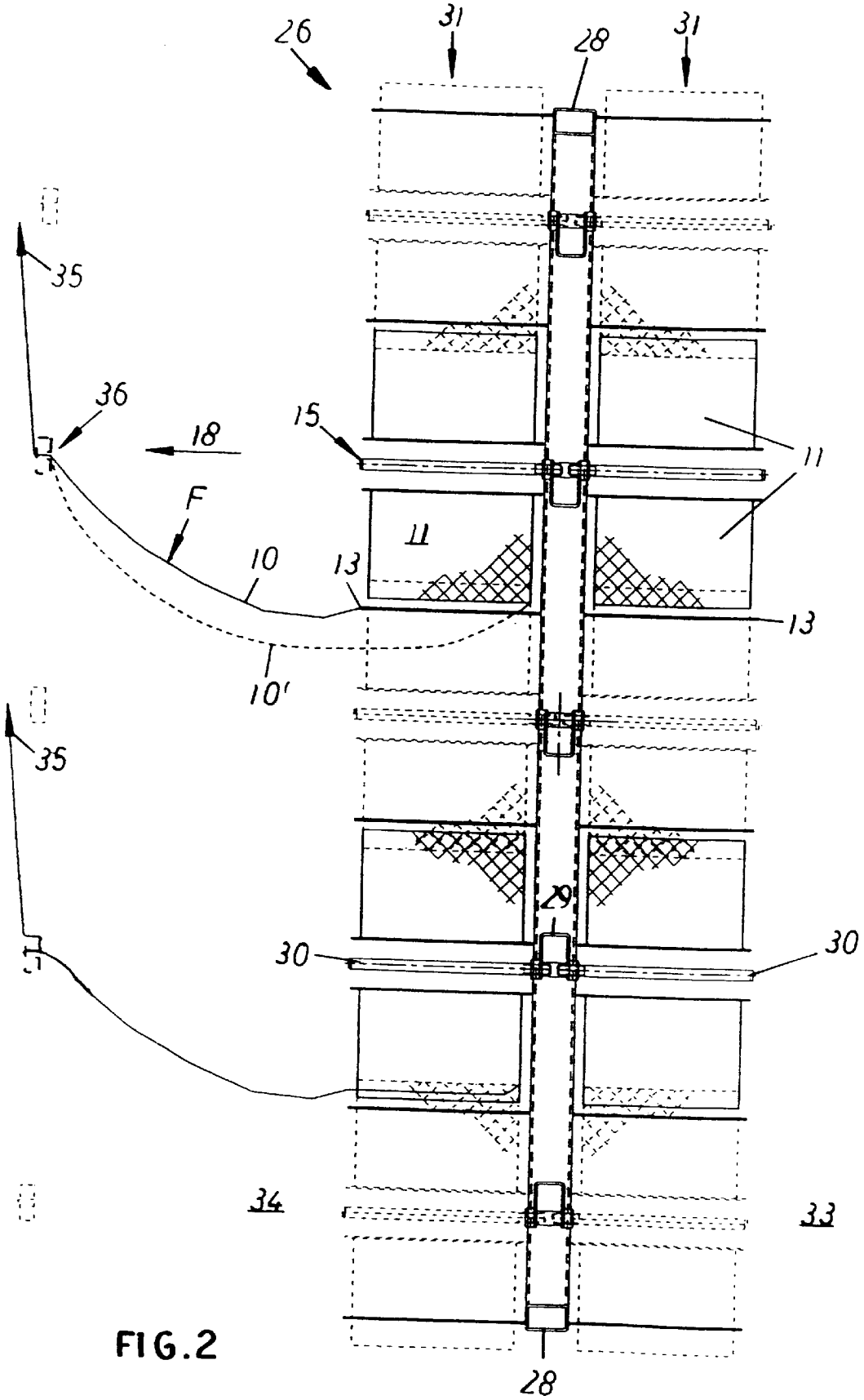
FIG. 2 is a section taken along line II—II of FIG. 1.

As seen in FIGS. 1 and 2 a two-sided creel has a frame 26 with a service side 33 and a feed side 34. The frame 26 has horizontal rectangular-section upper and lower members 27 joined at their ends by end vertical members 28. Separate U-section vertical members 29 extend vertically between the members 27 and each define six different stations 15. To this end each member 29 carries six posts 30 on which are fitted respective bobbins 11 forming bobbin arrays 31 on each side of the frame 26 with the bobbins 11 separated horizontally and vertically from one another by narrow generally sinusoidal gaps 12. The posts 30 and stations 15 are set at longitudinally equal spacings 20 in vertical rows 14 but are offset by half this spacing 20 from member 29 to member 29. Thus outer surfaces 16 of the bobbins 11 actually overlap transversely with these bobbins 11 mounted very close to one another on the frame 26. The frame 26 is provided centrally on its top and bottom with pivot pins 32 so that as is standard when the feed side 34 is empty, it can be rotated through 180° about a vertical axis to move full bobbins from the service side 33 into position while the bobbins 11 are switched out against full ones on the service side 33.

As best seen in FIG. 2, filaments F from the bobbins 11 extend outward in a direction 18 perpendicular to the rows 14 and pass through respective stationary eyes 36 each incorporating a thread brake. These filaments F are pulled through these eyes 36 as indicated by arrow 35 to form a balloon around each of the bobbins 11. If unencumbered the balloons would assume the shape 10' shown in dashed lines, which would mean that the balloons of adjacent bobbins 11 would interfere with one another with the concomitant problems of catching on one another and breakage.

According to the invention these balloons 10' are prevented from forming by means of guides 13 that are formed in FIGS. 1 and 2 as thin sheet-metal plates. These guides 13 extend between the rows 14 and outside the two end rows. They are not straight, but instead are formed with corrugations 17 at a spacing 19 equal to the vertical spacing 20 of the holders 30 in the rows 14. Thus at horizontally adjacent stations 15 one side of the guide plate 13 is concave toward one of the stations 15 and immediately therebelow it is oppositely concave toward another of the stations 15. FIG. 2 clearly shows how these guide plates 13 extend transversely from between the bobbins 11 to a location somewhat outward past them. The shape of the guides 13 is such that, projected horizontally in the direction 18 perpendicular to the rows 14, the cylindrical outer surfaces 16 of the bobbins 11 are clear of the guides 13. In other words the guides 13 have the shape of the gaps 12 between adjacent rows 14. Thus one can switch bobbins 11 without interference from these guides 13. Nonetheless these guides 13 limit the balloons to the shape shown at 10 in FIG. 1, so that these balloons do not interfere with one another. As a result it is possible to reduce the spacing 12 to a bare minimum and, therefore, make the creel very compact.

Figure 3:
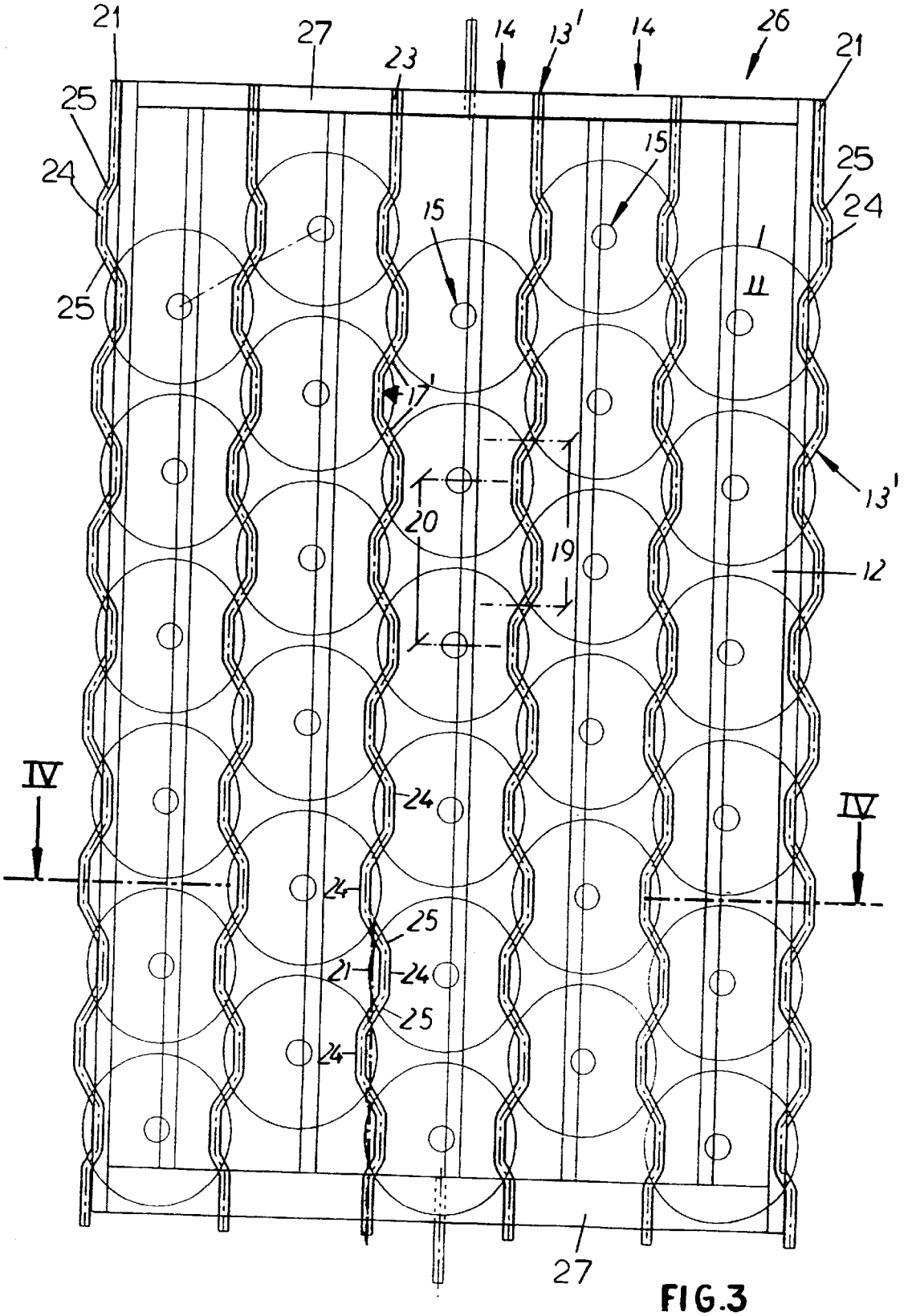
FIG. 3 is a view like FIG. 1 of another creel according to the invention.
Figure 4:
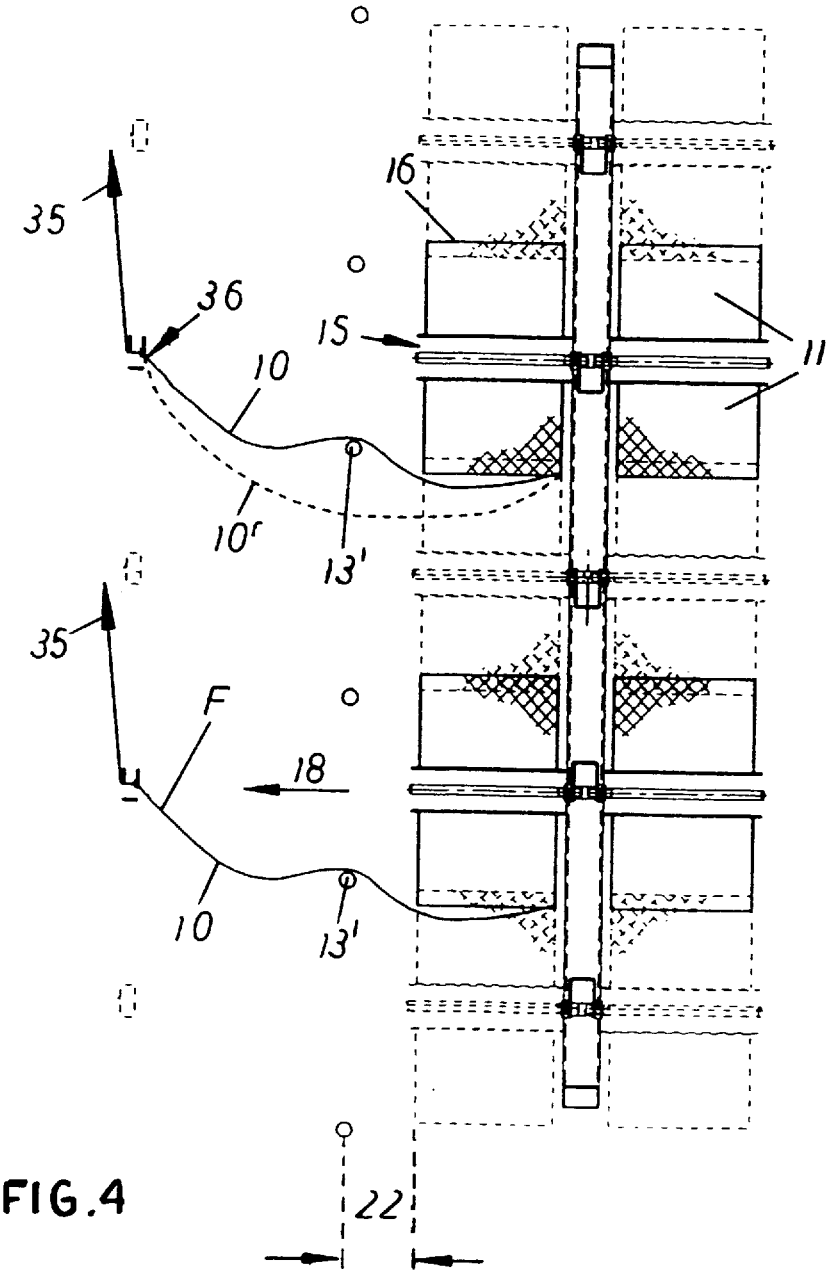
FIG. 4 is a section taken along line IV—IV of FIG. 3.

In the arrangement of FIGS. 3 and 4 guides 13' are used that are constituted as nonstraight wires or rods of generally sinusoidal shape mounted on the horizontal members 27 and set at a spacing 22 in the transverse direction 18 from the ends of the bobbins 11. Ends 23 of the guide rods 13' are mounted in the end members 27 for rotation. The ends 23 of each guide rod 13' are centered on respective axes 21 and the rods 13' have level with each holder 11 sections 25 that are parallel to but offset from the respective axis 21 and that are joined by angled sections 24 to the flanking sections 25 or to the end sections 23. In practice the sections 25 could be eliminated with the center portion of each guide 13' being zig-zag shaped by sections 24.

Figure 5:
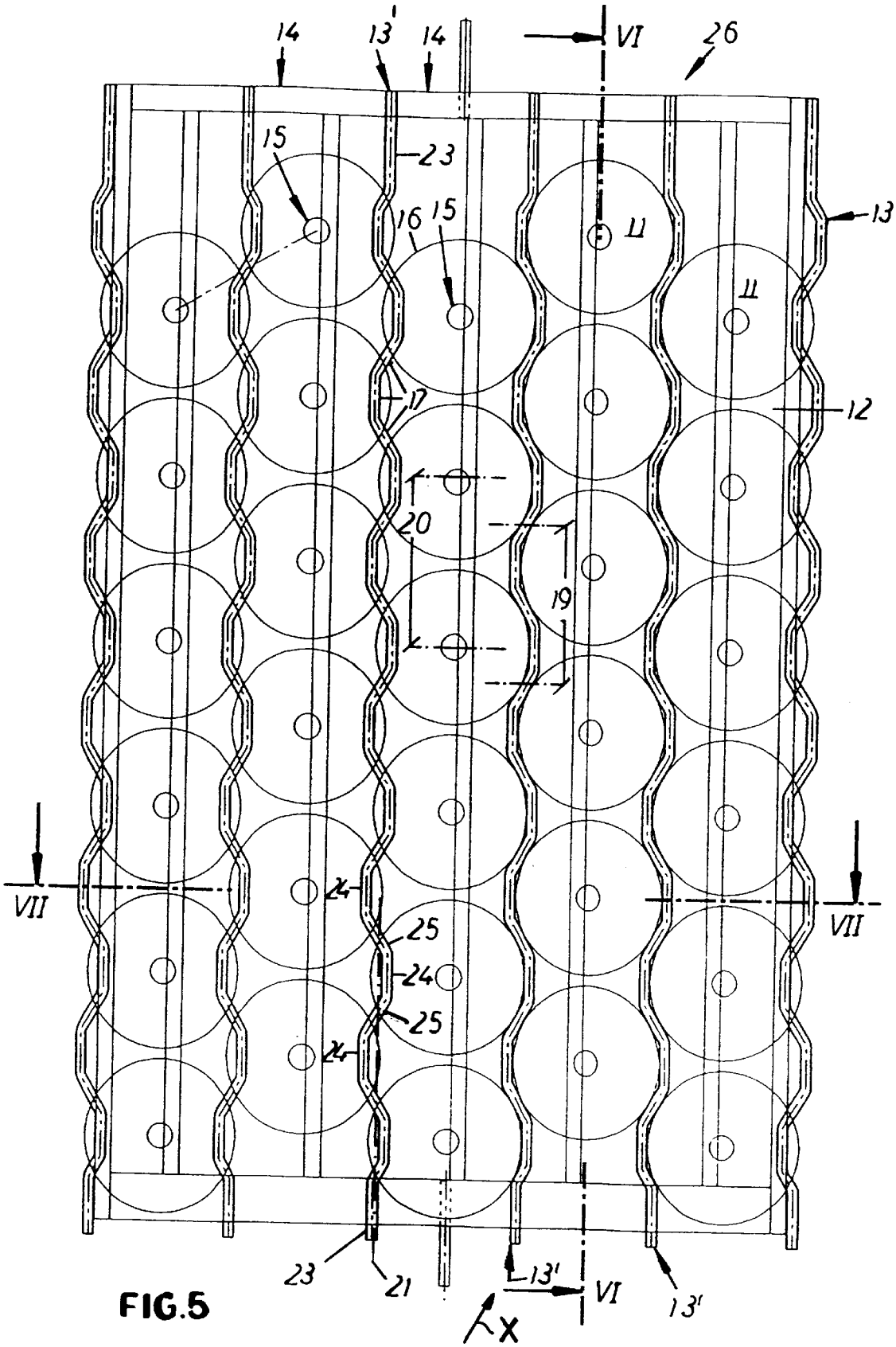
FIG. 5 is a view like FIG. 1 of yet another creel according to the invention.
Figure 6:
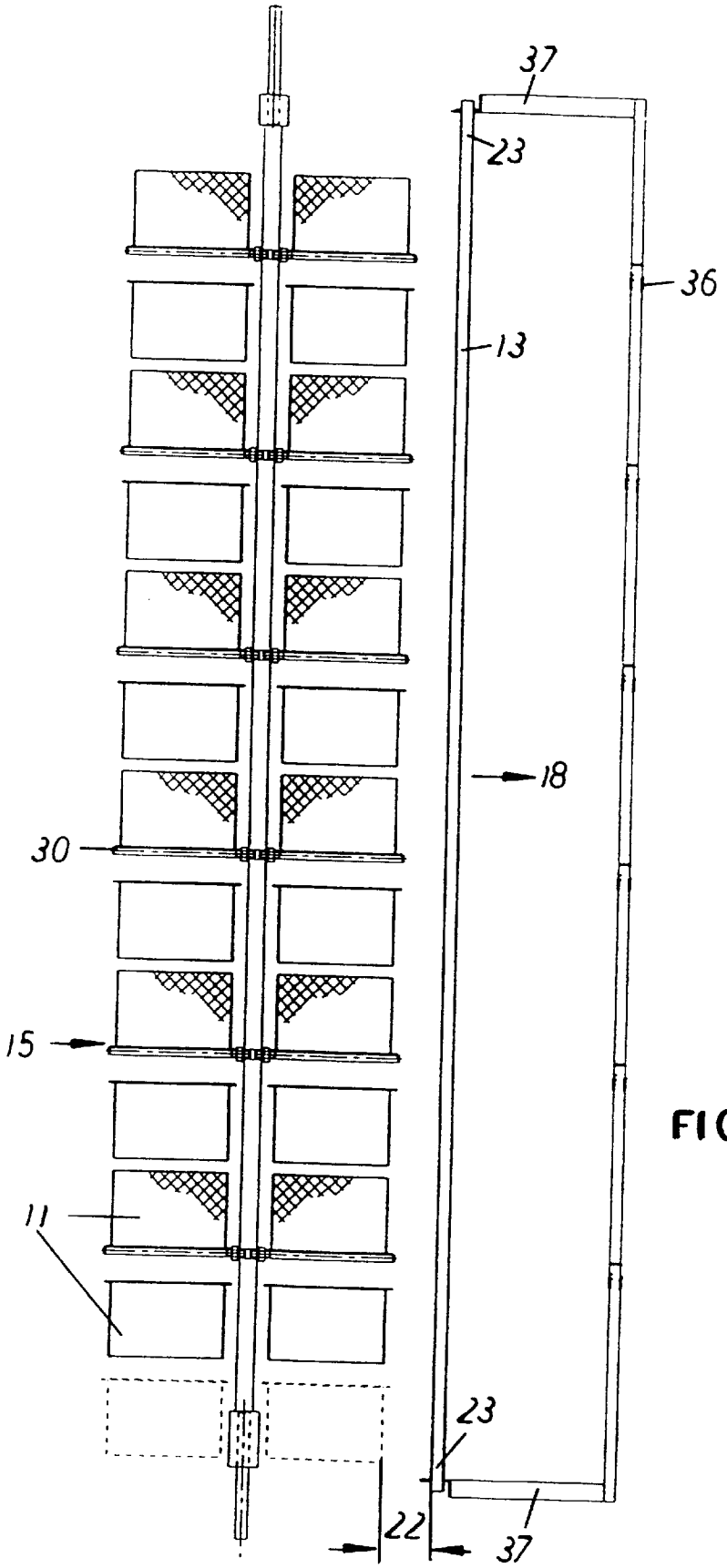
FIGS. 6 and 7 are sections taken along line VI—VI and VII—VII of FIG. 5.
Figure 7:
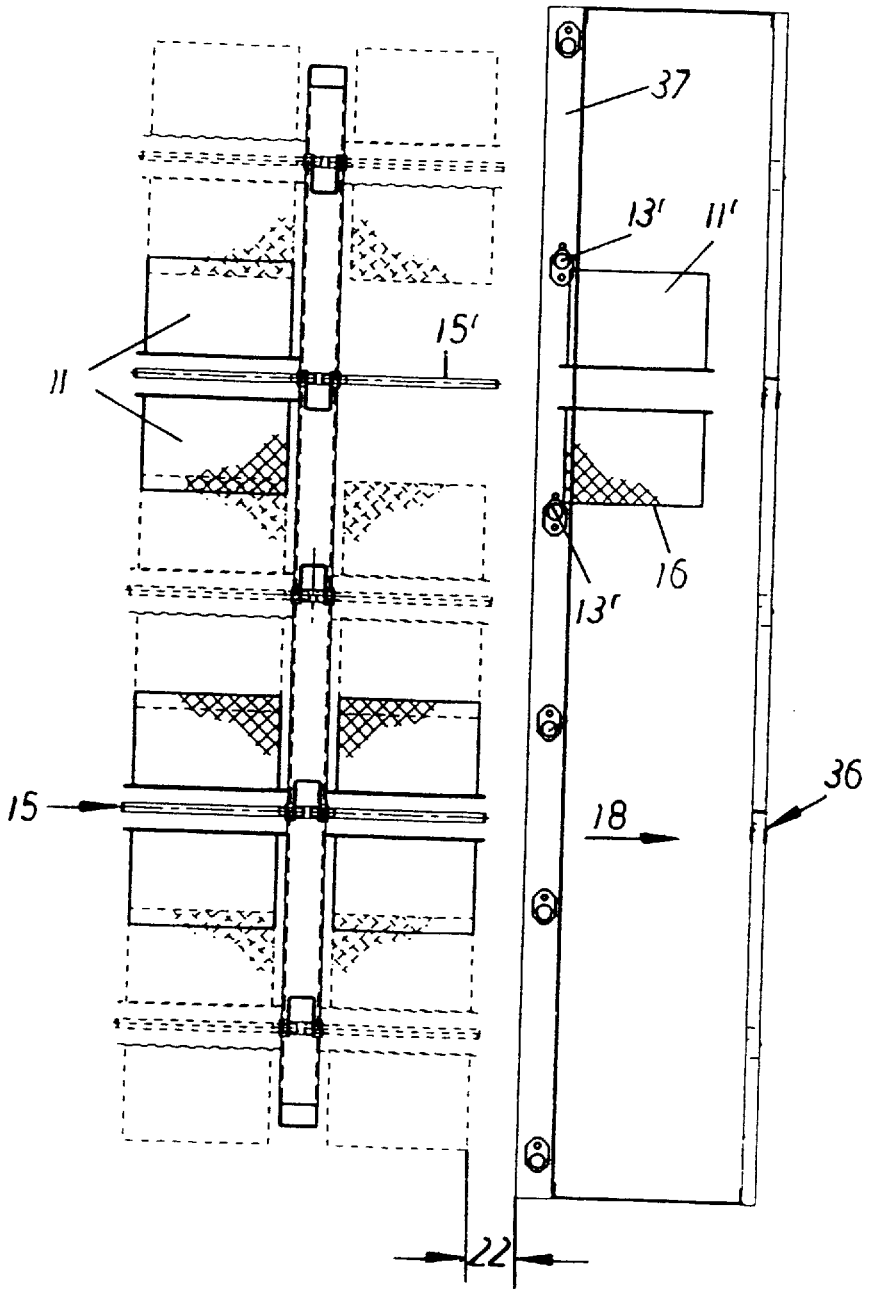

FIGS. 5 through 7 show how the guides 13' can be mounted on arms 37 that also carry the eye/brakes 36.

During normal operation as the filaments F are being pulled from the respective bobbins 11, the guide rods 13' are in the position illustrated in FIG. 3, that is with their curved sections 17' extending into a projection in direction 18 of the outer surfaces 16 of the bobbins 11. As a result they maintain the balloons 10 to a fairly limited diameter, completely eliminating the possibility that adjacent filaments F will catch on one another. Since most of the rods 13' will be engaged by six filaments on one side and six others on the exact opposite side, there will be no net force tending to rotate them out of position.

When, however, it is necessary to attend to a filament break or swap out a bobbin 11, it is possible to rotate the guides 13' about their axes 21 through 180° as indicated at X in FIG. 5, in which position the rods 13' lie wholly in the projection of the gaps 12 between the bobbins 11. This therefore makes it possible to move the bobbins 11 in and out in the transverse direction 18 without interference from the guides 13'.

We claim:

1. A creel comprising:

a frame provided with a plurality of parallel and longitudinally extending rows of holders each adapted to carry a respective filament-carrying bobbin with the holders of each row longitudinally staggered relative to the holders of adjacent rows and defining nonstraight gaps with the holders of the adjacent rows;

respective eyes aligned transversely of the rows with the holders, filaments passing in a transverse direction from the bobbins to and through the respective eyes; and a respective longitudinally extending and nonstraight guide spaced transversely in the direction from the bobbins between the bobbins and the eyes, extending parallel to the rows, and each formed level with each holder of the respective rows with an arcuate section directed toward the holders of the respective rows and alignable in a first position in the transverse direction with the gaps between the bobbins.

2. The creel defined in claim 1 wherein the guides are rods and the arcuate sections of each rod are separated by a spacing equal to a longitudinal spacing between adjacent holders in a row.

3. The creel defined in claim 2 wherein each guide rod is rotatable in the frame about an axis flanked by the respective arcuate sections between the first position and a second position with the arcuate sections out of alignment with the gaps of the respective rows and extending into a projection in the transverse direction of the respective bobbins.

4. The creel defined in claim 3 wherein the rods are spaced in the transverse direction from the bobbins.

5. The creel defined in claim 3 wherein the rods have ends lying on the respective axes and seated rotatable in the frame.

6. The creel defined in claim 1 wherein the guides are corrugated plates set between the rows and extending in the transverse direction from the gaps between the rows.

7. The creel defined in claim 6 wherein the guides are made of metal, perforated metal, or plastic.

8. The creel defined in claim 1 wherein each arcuate section has a pair of angled straight sections.

9. The creel defined in claim 8 wherein each arcuate section has a central straight section between the respective angled straight sections.

* * * * *